US007819983B2

(12) United States Patent
Kim et al.

(10) Patent No.: US 7,819,983 B2
(45) Date of Patent: Oct. 26, 2010

(54) DISHWASHER AND CONTROLLING METHOD THEREOF

(75) Inventors: Seong Ho Kim, Seoul (KR); Joon Ho Pyo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/457,548

(22) Filed: Jun. 15, 2009

(65) Prior Publication Data

US 2010/0043840 A1 Feb. 25, 2010

(30) Foreign Application Priority Data

Aug. 21, 2008 (KR) ..... 10-2008-0081800

(51) Int. Cl.
*B08B 9/20* (2006.01)

(52) U.S. Cl. ..... 134/25.2

(58) Field of Classification Search ..... None
See application file for complete search history.

(56) References Cited

U.S. PATENT DOCUMENTS

2002/0007843 A1* 1/2002 Deiss et al. ..... 134/25.2

* cited by examiner

*Primary Examiner*—Michael Kornakov
*Assistant Examiner*—Ryan Coleman
(74) *Attorney, Agent, or Firm*—McKenna Long & Aldridge LLP

(57) ABSTRACT

A dishwasher and controlling method thereof are disclosed, by which noise generated from rotation of a passage switching valve can be reduced in a manner of adjusting a rotation timing point of the passage switching valve and a rotation speed of a wash pump. The embodiments describe rotating a passage switching valve for switching a passage to selectively supply water to either an upper nozzle or a lower nozzle and reducing a rotational speed of a wash pump supplying the water to the upper and lower nozzles before the rotation of the passage switching valve.

6 Claims, 5 Drawing Sheets

DISHWASHER AND CONTROLLING METHOD THEREOF

This application claims the benefit of the Korean Patent Application No. 10-2008-0081800, filed on Aug. 21, 2008, which is hereby incorporated by reference as if fully set forth herein.

BACKGROUND OF THE INVENTION

1. Field of the Invention

The present invention relates to a dishwasher, and more particularly, to a dishwasher and controlling method thereof. Although the present invention is suitable for a wide scope of applications, it is particularly suitable for switching a passage of water supplied to an upper/lower nozzle using a passage switching valve.

2. Discussion of the Related Art

Generally, a dishwasher is a device for washing tableware in a manner of spraying high-pressure water into a washtub to separate particles such as leftover food attached to a surface of tableware from the tableware.

The dishwasher includes a washtub provided within a case, upper and lower racks slidably loaded in upper and lower parts of the washtub, respectively, and upper and lower nozzles rotatably provided to the upper and lower racks to spray water, respectively.

A sump for collecting the water sprayed into the washtub is provided to a bottom of the washtub. A wash pump for pumping supplied water to the upper and lower nozzles is provided to the sump.

The upper and lower nozzles are connected to the wash pump via upper and lower passages, respectively. Hence, if the wash pump is activated, the water within the sump is supplied to the upper and lower nozzles via the upper and lower passages, respectively. The upper and lower nozzles then rotate and spray the water into the washtub.

A passage switching valve, for turning on/off the upper/lower passage by blocking the upper/lower passage selectively, is provided to a diverging portion between the upper and lower passages.

The passage switching valve is coupled to a motor, which rotates the passage switching valve to selectively block the upper/lower passage.

However, while the wash pump is being driven at a high speed, if the passage switching valve is rotated to switch the passage, noise is caused by the pressure variation generated from rotating the passage switching valve.

SUMMARY OF THE INVENTION

Accordingly, the present invention is directed to a dishwasher and controlling method thereof that substantially obviates one or more problems due to limitations and disadvantages of the related art.

A feature of the present invention is to provide a dishwasher and controlling method thereof, by which noise, caused by a pressure variation generated from turning a passage switching valve provided to a diverging portion between upper and lower passages, can be reduced.

Additional advantages and features of the invention will be set forth in part in the description which follows and in part will become apparent to those having ordinary skill in the art upon examination of the following or may be learned from practice of the invention. The features and advantages of the invention may be realized and attained by the structure particularly pointed out in the written description and claims hereof as well as the appended drawings.

To achieve these and other advantages, and in accordance with the purpose of the invention as embodied and broadly described herein, a method of controlling a dishwasher according to the present invention may include the steps of rotating a passage switching valve for switching a passage to selectively supply water to either an upper nozzle or a lower nozzle and reducing a rotational speed of a wash pump supplying the water to the upper and lower nozzles before a rotation of the passage switching valve.

Preferably, the method further includes the step of if the rotation of the passage switching valve is completed, returning the rotational speed of the wash pump to an original, rotational speed.

More preferably, the rotational speed of the wash pump returns to the original rotational speed while the passage switching valve is operating.

Preferably, the passage switching valve is rotated at a timing point that a reduction of the rotational speed of the wash pump is completed.

Preferably, the rotational speed of the wash pump gradually becomes reduced with a prescribed slope.

Preferably, the rotation of the passage switching valve is performed in a predetermined period.

In another aspect of the present invention, a method of controlling a dishwasher includes a first operating step of supplying water selectively to an upper or lower nozzle by rotating a wash pump at a first rotational speed and a second operating step of rotating a passage switching valve for switching a passage of the water introduced into the upper or lower nozzle by rotating the wash pump at a second rotational speed lower than the first rotational speed.

Preferably, a rotational speed reduction to the second rotational speed from the first rotational speed is completed before a rotation of the passage switching valve is performed.

More preferably, the rotational speed of the wash pump gradually becomes reduced with a prescribed slope.

Preferably, if the rotation of the passage switching valve is completed, the second rotational speed is raised to the first rotational speed.

More preferably, the second rotational speed is raised to the first rotational speed while the passage switching valve is operating.

In another aspect of the present invention, a dishwasher includes a washtub, upper and lower nozzles for supplying water to the washtub, a sump provided under the washtub to collect the water therein, a wash pump pumping the water to the washtub from the sump, a passage switching valve enabling the water pumped by the wash pump to be selectively supplied to either the upper nozzle or the lower nozzle, and a controller controlling a rotational speed of the wash pump to be reduced prior to a rotation of the passage switching valve.

Preferably, the controller controls the passage switching valve to be rotated at a timing point at which a variation of the rotational speed of the wash pump ends.

Preferably, the dishwasher further includes a detector detecting the rotation of the passage switching valve.

Preferably, the dishwasher further includes a driving means for rotating the passage switching valve to enable to water pumped by the wash pump to be selectively discharged via either the upper nozzle or the lower nozzle.

Accordingly, a dishwasher and controlling method thereof according to the present invention reduce the noise generated from turning a passage switching valve that switches a passage of water to enable the water to be selectively supplied to an upper/lower nozzle.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
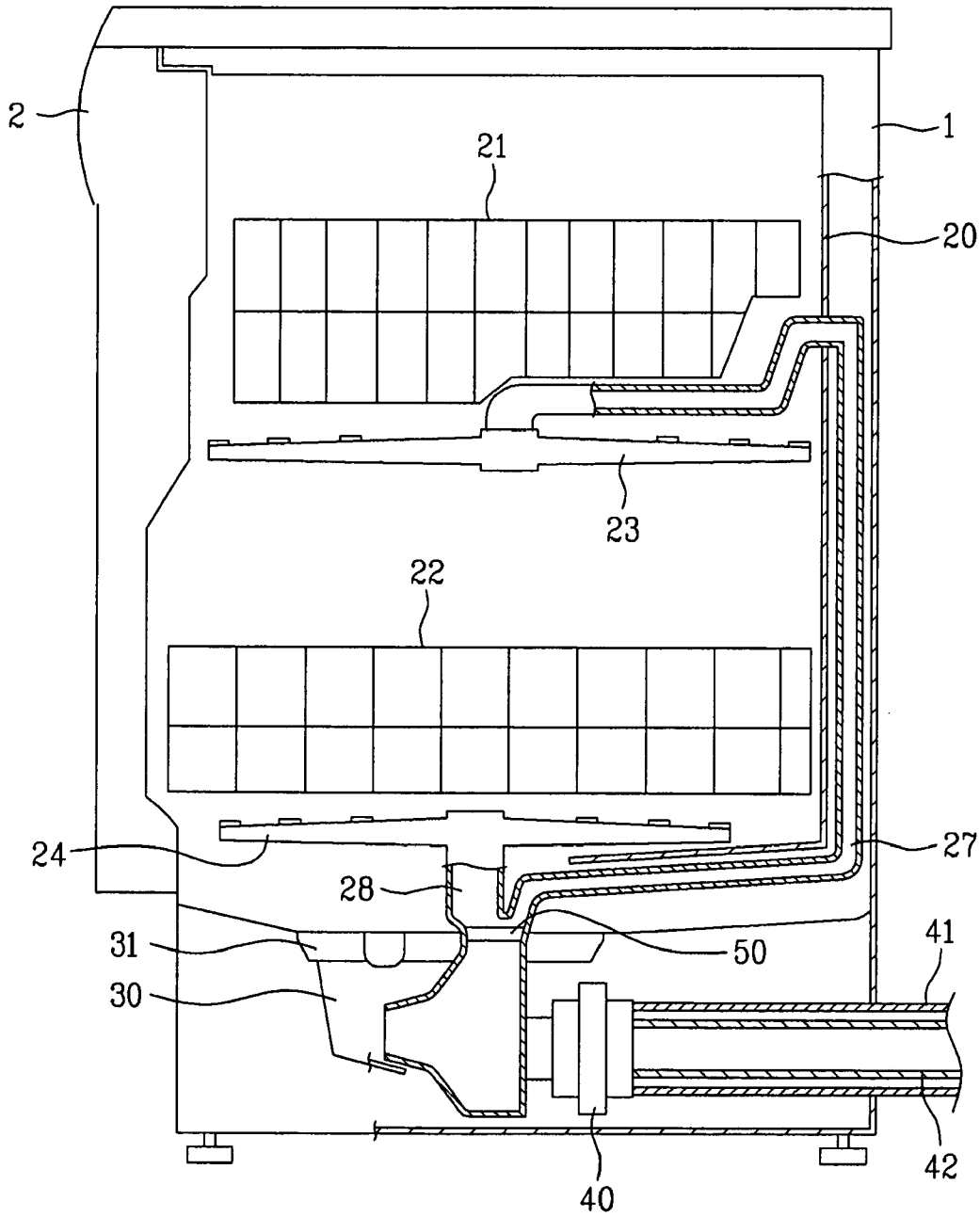
FIG. 1 is a cross-sectional diagram of a dishwasher according to one embodiment of the present invention.
Figure 2:
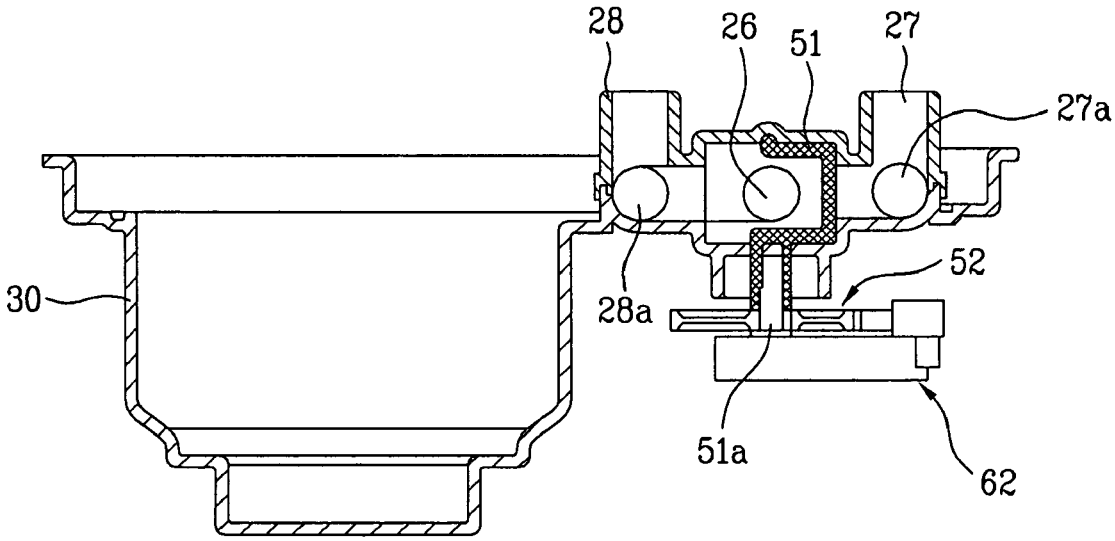
FIG. 2 is a vertical cross-sectional diagram of a passage switching valve provided to the dishwasher shown in FIG. 1.

FIG. 1 is a cross-sectional diagram of a dishwasher according to one embodiment of the present invention, and FIG. 2 is a vertical cross-sectional diagram of a passage switching valve provided to the dishwasher shown in FIG. 1.

Referring to FIG. 1 and FIG. 2, a dishwasher according to one embodiment of the present invention includes a case 1 defining an exterior of the dishwasher and a door 2 for opening or closing an open front side of the case 1.

A washtub 20 is provided within the case 1 to accommodate water therein. A sump 30 is provided to a bottom of the washtub 20. The sump 30 collects water sprayed into the washtub 20. A filter 31 is provided to a topside of the sump 30 to filter particles from the water introduced into the sump 30.

Within the washtub 20, there are provided an upper rack 21 and a lower 22. The racks 21, 22 are vertically separated from each other to accommodate tableware that is positioned on the racks and to accommodate upper and lower nozzles 23 and 24 to spray water toward the upper and lower racks 21 and 22. Upper and lower passages 27, 28, respectively are provided within the washtub 20 to supply the water collocated in the sump 30 to the upper and lower nozzles 23 and 24 provided to the washtub 20, respectively.

A water supply pipe 41 is provided to enable water to be supplied into the washtub 20 by connecting the washtub 20 and a water supply source outside the case 1. In addition, a drain pipe 42 is provided to drain polluted water to be discharged outside the dishwasher.

A wash pump 35 is provided to the sump 30 to supply water to the upper and lower nozzles 23 and 24. The water pumped by the wash pump 35 is selectively supplied to the upper and lower nozzles 23, 24 via the upper and lower passages 27, 28.

A passage switching device 50 is provided to a diverging portion between the upper and lower nozzles 23 and 24. The passage switching device 50 may enable the water supplied in the sump 30 to be selectively supplied to the upper and lower nozzles 23, 24.

The passage switching device 50 according to one embodiment of the present invention, as shown in FIG. 2, includes a passage switching valve 51 rotatably provided to one side of the sump 30, and more particularly, to a diverging portion between the upper and lower passages 27 and 28. The passage switching valve 51 may selectively block the upper or lower passages 27, 28 to enable the water to be selectively supplied to the upper or lower passages. A driving means 52 for turning the passage switching valve 51 is also provided.

An inlet 26 for introducing the water from the sump 30 and upper and lower outlets 27*a* and 28*a*, respectively, for discharging the water to the upper and lower passages 27 and 28, respectively are provided to the diverging portion between the upper and lower passages 27 and 28. The passage switching valve 51 is configured to have a partially cylindrical shape and is provided to the diverging portion of the passages to selectively block the inlet 26 and the upper and lower outlets 27*a* and 28*a*. A rotational shaft 51*a* of the passage switching valve 51 is coupled with the driving means 52.

Preferably, the driving means 52 includes a motor for turning the passage switching valve 51. More preferably, the driving means 52 includes a step motor.

Figure 3:
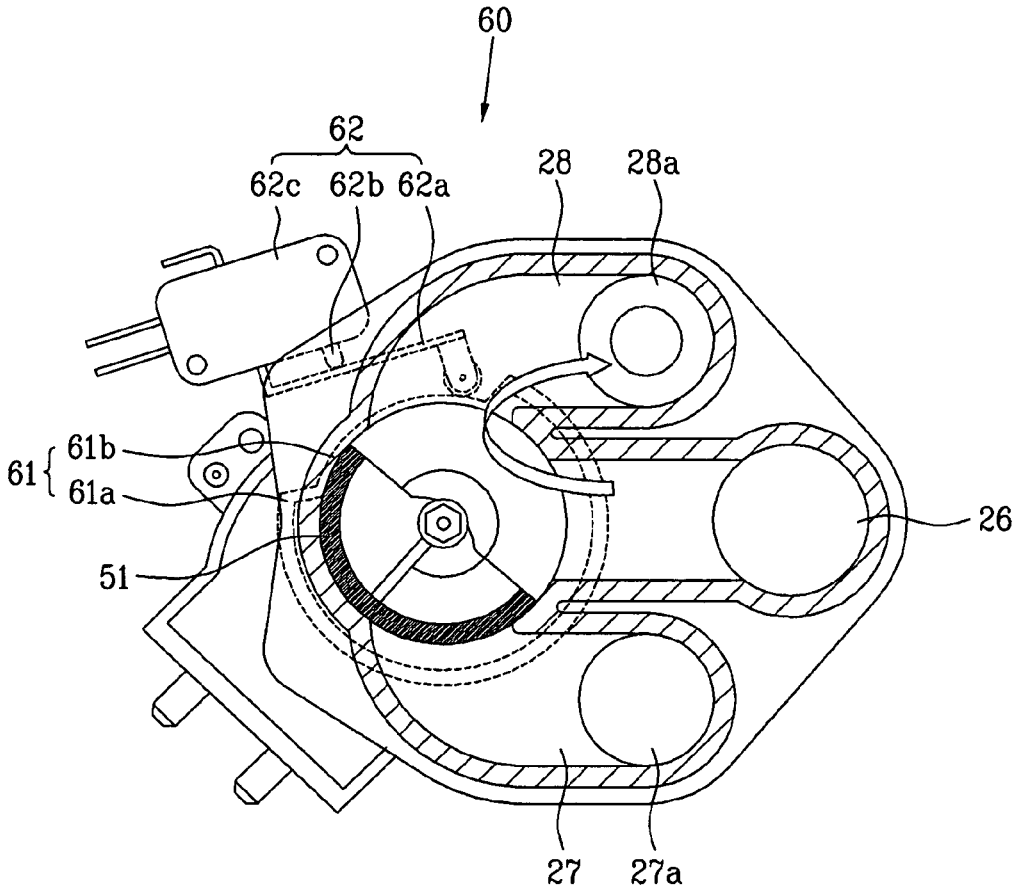
FIG. 3 is a horizontal cross-sectional diagram of a passage switching valve provided to the dishwasher shown in FIG. 1.

A dishwasher according to one embodiment of the present invention, as shown in FIG. 3, includes a detecting device 60 for detecting the turning of the passage switching valve 51.

The detecting device 60 includes a cam 61 having a plurality of sections provided to the rotational shaft 51*a*. The plurality of sections differ from each other in radius. A sensing part 62, which mechanically contacts an outer radial surface of the cam 61, detects a position of the passage switching valve 51 according to the radius of the cam 61 at the contacted surface.

In particular, in the embodiment of FIG. 3, the sensing part 62 includes an operational lever 62*a* elastically supported by an outer surface of the cam 61 and a switch plunger 62*b* that closes a micro-switch 62*c* when it is depressed into the body of a micro-switch 62*c* and opens the micro-switch 62*c* when it is released and extends out of the body of a micro-switch 62*c*. Thus, as the operational lever 62*a* is pushed closer to the micro-switch 62*c* by an increased radius of the cam 61, the plunger 62*b* is depressed into the body of the micro-switch 62*c* and closes the switch contact therein. Closing the switch contact enables a current to flow through the micro-switch 62*c*. According to this exemplary embodiment, the micro-switch 62*c* may provide a signal to a microcomputer (not shown) that is a function of the cam's 61 position.

The cam 61 includes a first curved portion 61*a* and a second curved portion 61*b*. The first curved portion 61*a* is configured to have a radius is larger than that of the second curved portion 61*b*. The distance between the area on the operational lever that contacts the plunger 62*b* and the body of the micro-switch 62*c* is a function of the position of the cam 61. The distance is reduced when the operational lever 62*a* is pushed outward from the center of the cam 61 by the larger radius of the first curved portion 61*a*. Conversely, the distance is increased when the operational lever 62*a* is permitted to move inward in a direction of the center of the cam 61 by the smaller radius of the second curved portion 61*b*. The radius of the first curved portion 61*a* is sufficient to enable the micro-switch 62*c* to maintain a turned-on (or closed contact) state when the plunger 62*b* is depressed by the operational lever 62*a*. The radius of the second curved portion 61*b* is sufficient to enable the micro-switch 62*c* to maintain a turned-off (or open contact) state when the plunger 62*b* is permitted to extend out of the body of the micro-switch 62*c* by virtue of an increased distance between the body of the micro-switch 62*c* and the operational lever 62*a*.

Thus, if the detecting device 60 is provided, the position of the cam, and therefore the position of the passage switching valve 51, can be obtained. Thus, the microcomputer (not shown) is able to determine whether the passage switching valve 51 is positioned to allow water to flow to either the upper passage 27 or the lower passage 28.

Figure 4:
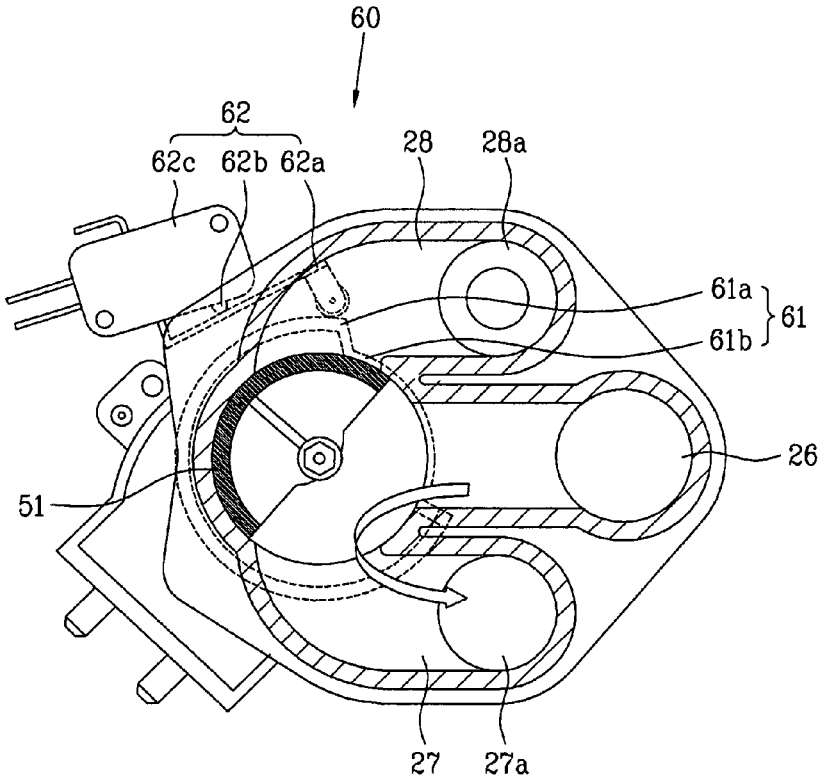
FIG. 4 is an operational diagram of the passage switching valve shown in FIG. 3.

FIG. 3 shows the passage switching valve 51 rotationally positioned to enable the inlet 26 and the lower outlet 28*a* to communicate with each other. FIG. 4 shows the passage switching valve 51 rotationally positioned to enable the inlet 26 and the upper outlet 27*a* to communicate with each other.

In the embodiment of FIG. 3, when the passage switching valve 51 is rotationally positioned to enable the inlet 26 and the lower outlet 28*a* to communicate with each other, the operational lever 62*a* is supported by the second curved portion 61*b* of the cam 61. In this configuration, the plunger is not depressed into the body of the micro-switch to a depth that would be sufficient to close the contact of the micro-switch 62*c*. Referring to FIG. 4, when the passage switching valve 51 is rotationally positioned to enable the inlet 26 and the upper outlet 27*a* to communicate with each other, the operational lever 62*a* is supported by the first curve portion 61*a* of the cam 61. In this configuration, the plunger is depressed into the body of the micro-switch 62*c* to a depth that is sufficient to close and maintain closure of the contact of the micro-switch 62*c*. Accordingly, based on the state indicated by the micro-switch 62*c*, the microcomputer (not shown) is able to determine whether the passage switching valve 51 is positioned to allow water to flow to the upper outlet 27*a* or the lower outlet 28*a*.

Figure 5:
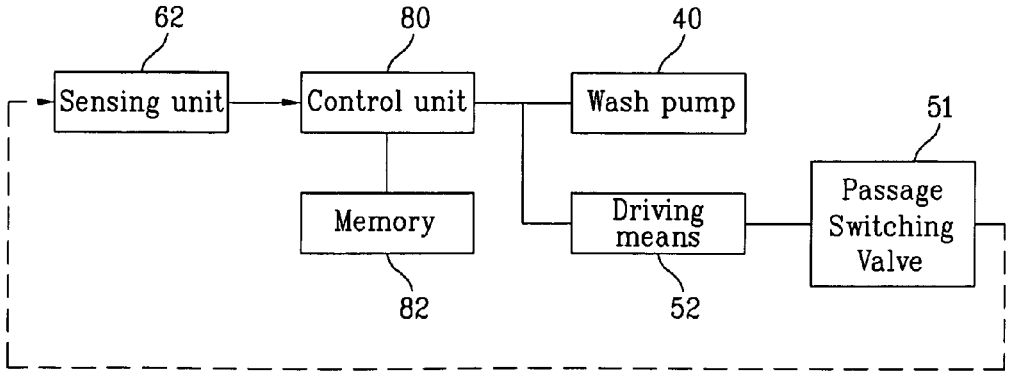
FIG. 5 is a block diagram illustrating the relationship between various devices provided to the dishwasher shown in FIG. 1.

FIG. 5 is a block diagram illustrating the relationship between various devices provided to the dishwasher shown in FIG. 1.

Referring to FIG. 5, a control unit 80 receives a signal from a sensing unit 62 of the detecting device 60. Based on the signal, the control unit 80, which may be a microcomputer, determines whether the passage switching valve 51 is passing water to the upper passage 27 or the lower passage 28. Based on this determination, the control unit 80 controls the speed (as measured in revolutions per minute (RPM)) of a wash pump 40. The control unit 80 also controls a driving means 52 for changing a state of the passage switching valve 51. Where, for example, a first state is reached when the passage switching valve 51 is positioned to permit water to flow from the inlet 26 the upper outlet 27*a* and a second state is reached when the passage switching valve 51 is positioned to permit water to flow from the inlet 26 to the lower outlet 28*a*. In the exemplary embodiments discussed above, the change of state is produced by rotating the passage switching valve 51. Additionally, in the exemplary embodiments discussed above, the sensing unit 62 is mechanically coupled to the passage switching valve 51. Thus, the sensing unit 62 provides feedback of the position of the passage switching valve 51 to the control unit 80. Also illustrated in FIG. 5 is a memory 82. Memory 82 may store code, which when executed by the control unit 80 will cause the dishwasher to perform the steps of the methods described herein.

In the following description, a method of controlling the above-described dishwasher is explained with reference to FIG. 6.

Figure 6:
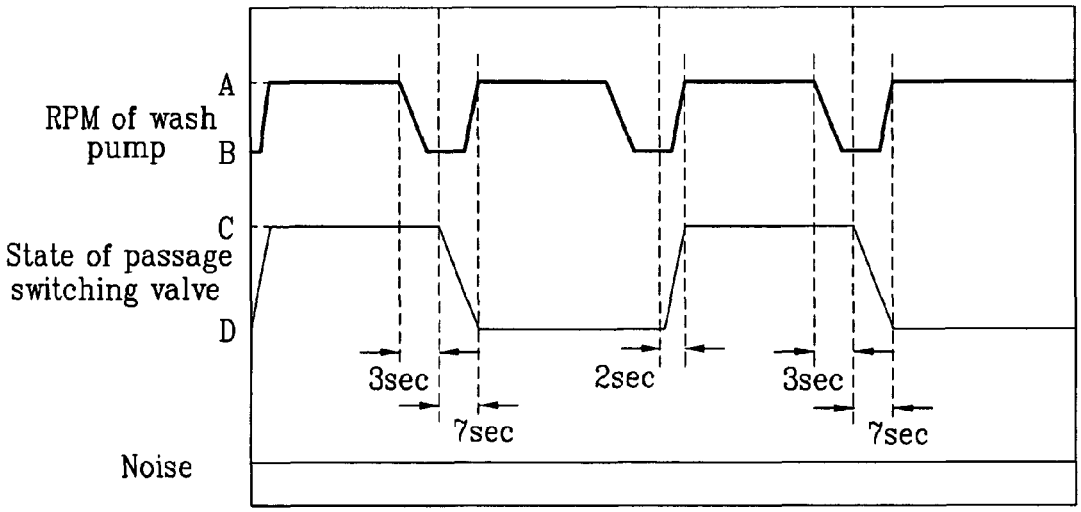
FIG. 6 is a diagram of a method of controlling a dishwasher according to the present invention.

FIG. 6 is a diagram of a method of controlling a dishwasher according to the present invention.

Referring to FIG. 6, a dishwasher according to the present invention performs the steps of preliminary washing, main washing, rinsing, heated washing, and drying sequentially or selectively. A discharging step of discharging water is performed between the respective steps.

Once the main washing step is executed, the wash pump 40 is driven to supply the water collected in the sump 30 to the washtub 20.

In this case, the water pumped by the wash pump 40 is selectively supplied to the upper or lower nozzles 23, 24 by rotating the passage switching valve 51 provided to the diverging portion between the upper and lower passages 27 and 28.

In order to reduce the noise generated from rotating the passage switching valve 51 from one position to another, the control unit 80 reduces a rotational speed of the wash pump 40 supplying the water to the upper or lower nozzle 23, 24 before the passage switching valve 51 is rotated.

Thus, by rotating the passage switching valve 51 after reducing the rotational speed of the wash pump 40, the dishwashing machine is able to reduce the noise generated from the pressure variations when the passage switching valve 51 is rotated.

FIG. 6 depicts the control of the passage switching valve 51 and the wash pump 40 in the main washing. Although the above description was made with reference to the main washing cycle, it will be understood that the passage switching valve 51 and the wash pump 40 may be operated according to the same methodology when the dishwashing machine is in the preliminary washing cycle, the rinsing cycle, or the like.

In FIG. 6, 'A' indicates a state that the wash pump is rotating at a first rotational speed (high speed) and 'B' indicates a state that the wash pump is rotating at a second rotational speed (low speed), lower that the first rotational speed. Moreover, 'C' indicates a state in which the passage switching valve 51 is positioned to permit water to flow to the upper passage 27 while 'D' indicates a state in which the passage switching valve 51 is positioned to permit water to flow to the lower passage 28.

Referring to FIG. 6, when the passage switching valve 51 turns on the lower passage 28, it takes about two seconds for the passage switching valve 51 to rotate in order to turn on the upper passage 27. On the contrary, when the passage switching valve 51 turns on the upper passage 27, it takes about seven seconds for the passage switching valve 51 to rotate in order to turn on the lower passage 28.

In order to prevent the abnormal noise generated from rotating the passage switching valve 51, the control unit 80 starts to reduce the rotational speed of the wash pump 40 down to the second rotational speed B from the first rotational speed A about three seconds in advance to match an operational period of the driving means 52 for rotating the passage switching valve 51, whereby a pressure of the water supplied to the passage switching valve 51 is lowered.

In reducing the rotational speed of the wash pump 40, it is preferable that the rotational speed is reduced gradually with a prescribed slope. If the wash pump 40 is pumping water, it is difficult to change the rotational speed abruptly.

In the foregoing description, the rotational speed of the wash pump 40 supplying the water to the upper and lower nozzles 23 and 24 is reduced before the passage switching valve 51 is rotated. Alternatively, the passage switching valve 51 is able to change the passage to match a timing point of completing the reduction of the rotational speed of the wash pump 40.

Accordingly, by rotating the passage switching valve 51 in the state that the pressure of the water is reduced, it is able to reduce the undesirable noise generated from rotating the passage switching valve 51.

Once the operation of the driving means 52 is completed, the rotational speed of the wash pump 40 may be made to return to the original rotational speed (first rotational speed A) from the second rotational speed B. Therefore, the wash performance is not reduced but maintained constant.

Meanwhile, the reduced rotational speed of the wash pump 40 preferably returns to the original rotational speed while the passage switching valve 51 is operating. Because it takes a prescribed time for the rotational speed of the wash pump 40 to return to the original rotational speed, the wash pump 40 is made to rotate at the original rotational speed at the timing point that the passage switching valve 51 completes the switching of the passage.

Accordingly, as mentioned in the above description, the dishwasher according to the present invention reduces the rotational speed of the wash pump 40 prior to the activation of the passage switching valve 51, thereby reducing the undesirable noise generated from the rotation of the passage switching valve 51.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of controlling a dishwasher, comprising the steps of:

selectively supplying water, received by a passage switching valve, to one of an upper nozzle and a lower nozzle by positioning the passage switching valve in a first fixed state for a first period of time;

rotating the passage switching valve such that the passage switching valve becomes fixed in a second state in which water is selectively supplied to the nozzle that was not previously supplied with water in the previous step, wherein a rotational speed of a wash pump supplying water to the passage switching valve is reduced from a first speed to a second speed, less than the first, before the passage switching valve is rotated, and wherein the rotational speed of the wash pump is increased back to the first speed while the passage switching valve is rotating and before the passage switching valve becomes fixed in the second state.

2. The method of claim 1, wherein the rotational speed of the wash pump is reduced at a predetermined rate.

3. The method of claim 1, wherein the amount of time required to change the state of the passage switching valve is predetermined.

4. A method of controlling a dishwasher, comprising:

a first operating step of selectively supplying water, by positioning a passage switching valve in a first fixed position for a first period of time, to an upper or lower nozzle while rotating a wash pump, at a first rotational speed; and a second operating step of rotating the wash pump at a second rotational speed, lower than the first rotational speed, before changing a position of the passage switching valve by rotating the passage switching valve, and rotating the passage switching valve such that the passage switching valve becomes fixed at a second position in which water is selectively supplied to the nozzle that was not previously supplied with water in the first operating step, wherein the rotational speed of the wash pump is increased back to the first speed while the passage switching valve is rotating and before the passage switching valve becomes fixed in the second position.

5. The method of claim 4, wherein the rotational speed of the wash pump is reduced at a predetermined rate.

6. The method of claim 1, wherein the change of state of the passage switching valve is produced by a rotation of the passage switching valve from a first axial position to a second axial position, different from the first.

* * * * *